US010589905B2

(12) United States Patent
Wang et al.

(10) Patent No.: US 10,589,905 B2
(45) Date of Patent: Mar. 17, 2020

(54) AIRTIGHT CONTAINER

(71) Applicants: Soo Jung Wang, Gyeonggi-do (KR); Young Bin Wang, Gyeonggi-do (KR); Bang Hyang Song, Seoul (KR)

(72) Inventors: Soo Jung Wang, Gyeonggi-do (KR); Young Bin Wang, Gyeonggi-do (KR); Bang Hyang Song, Seoul (KR)

( * ) Notice: Subject to any disclaimer, the term of this patent is extended or adjusted under 35 U.S.C. 154(b) by 42 days.

(21) Appl. No.: 15/968,875

(22) Filed: May 2, 2018

(65) Prior Publication Data

US 2018/0334295 A1 Nov. 22, 2018

(30) Foreign Application Priority Data

May 17, 2017 (KR) ..... 10-2017-0060802

(51) Int. Cl.
*B65D 43/02* (2006.01)
*B65D 43/26* (2006.01)

(52) U.S. Cl.
CPC ..... *B65D 43/0208* (2013.01); *B65D 43/021* (2013.01); *B65D 43/267* (2013.01); *B65D 2543/005* (2013.01); *B65D 2543/00027* (2013.01); *B65D 2543/0074* (2013.01); *B65D 2543/00203* (2013.01); *B65D 2543/00296* (2013.01); *B65D 2543/00462* (2013.01);
(Continued)

(58) Field of Classification Search
CPC ..... B65D 25/28; B65D 43/0208; B65D 43/0206; B65D 43/0204; B65D 43/0202; B65D 43/02; B65D 43/021; B65D 43/267; B65D 43/22; B65D 43/26; B65D 45/16; B65D 45/34; B65D 45/32
USPC ..... 220/324, 321, 320, 315, 729, 754, 755, 220/756, 263, 262, 260, 380, 657, 805, 220/803, 802, 801
See application file for complete search history.

(56) References Cited

U.S. PATENT DOCUMENTS 1,759,020 A * 5/1930 Nornable ..... B65D 43/267 220/285
2,690,921 A * 10/1954 Braun ..... B65D 45/16 292/113
(Continued)

FOREIGN PATENT DOCUMENTS

DE 202015105350 U1 2/2017
GB 1096171 A * 12/1967 ..... B65D 43/021
(Continued)

*Primary Examiner* — Robert J Hicks
(74) *Attorney, Agent, or Firm* — Roberts Calderon Safran & Cole P.C.

(57) ABSTRACT

An airtight container has a lid which is easily opened by the principle of the lever thus preventing broth from splashing out when the lid is opened. The airtight container includes a container body having a latching bump and a bent flange, a rotating knob connected to the flange and having an opening-closing plate and a step portion, and a lid having a latching protrusion, a downwardly bent flange and a lid extension portion, wherein, when the rotating knob is just rotated upward in a state where the lid is coupled to the container body, the opening-closing plate lifts the lid extension portion by "the principle of the lever" while the step portion prevents the lid extension portion from spreading outwards, thereby allowing the latching protrusion to be released from the latching bump and the lid to be opened from the container body.

9 Claims, 7 Drawing Sheets

(52) U.S. Cl.
CPC ..... *B65D 2543/00509* (2013.01); *B65D 2543/00537* (2013.01); *B65D 2543/00555* (2013.01); *B65D 2543/00564* (2013.01); *B65D 2543/00629* (2013.01); *B65D 2543/00685* (2013.01); *B65D 2543/00796* (2013.01); *B65D 2543/00833* (2013.01); *B65D 2543/00842* (2013.01); *B65D 2543/00888* (2013.01); *B65D 2543/00944* (2013.01)

(56) References Cited

U.S. PATENT DOCUMENTS

| | | | | |
|---|---|---|---|---|
| 3,851,788 | A * | 12/1974 | Hammes | B65D 1/16 220/319 |
| 2004/0011791 | A1 | 1/2004 | Oh | |
| 2004/0262309 | A1 | 12/2004 | Edwards | |
| 2010/0012655 | A1* | 1/2010 | Dathy | B44D 3/127 220/262 |
| 2018/0265263 | A1* | 9/2018 | Li | B65D 45/20 |

FOREIGN PATENT DOCUMENTS

| | | | |
|---|---|---|---|
| JP | 08026314 | A | 1/1996 |
| JP | 08253255 | A | 10/1996 |
| JP | 10120004 | A | 5/1998 |
| JP | 2000-033961 | A | 2/2000 |
| JP | 2007-284090 | A | 11/2007 |
| JP | 2011-093594 | A | 5/2011 |
| JP | 2014-222732 | A | 11/2014 |
| KR | 20-0248959 | Y1 | 10/2001 |
| KR | 20-0301897 | Y1 | 1/2003 |
| KR | 20-0316253 | Y1 | 6/2003 |
| KR | 20-0360690 | Y1 | 1/2004 |
| KR | 20-0345664 | Y1 | 3/2004 |
| KR | 1020050039471 | A | 4/2005 |
| KR | 2020080000507 | U | 4/2008 |
| KR | 2020090000832 | U | 1/2009 |
| KR | 1020150109126 | A | 10/2015 |

* cited by examiner

AIRTIGHT CONTAINER

TECHNICAL FIELD

The present invention relates to an improvement of an airtight container for receiving and storing various foods and, more specifically, to an improvement of an opening/closing structure for opening or closing the lid of the airtight container.

BACKGROUND ART

Generally, an airtight container includes a container body and a lid for opening or closing an opening of the container body. A container having a packing member for airtight sealing, which is installed on one of a container body and a lid thereof, may be called an airtight container. Further, a container even without a packing member may be called an airtight container or a food container. Further, such an airtight container or food container may be used as a small article container for storing various small articles according to user intent.

In a conventional airtight container as described above, a lid opens or closes an opening of a container body. A rotating knob having a latching groove is formed on one of the container body and the lid, and a protrusion to be inserted into the latching groove to maintain a locked state is formed on the other thereof. When the latching groove and the protrusion are coupled to each other, the lid covers an opening of the container body to maintain the locked state. When the latching groove and the protrusion are decoupled, the locked state is released.

Meanwhile, in order to open a lid of a conventional container from an opening of a container body, either hands of a user may be used to simultaneously hold proper circumferential portions of the lid and then lift up the lid or one hand may be used to hold the container body while the other hand is used to hold a knob protruding from one side of the lid and then lift up the lid. The container may have various size and shapes.

A conventional airtight container may include a protruding knob formed on one selected from four corners of a lid, or flat plate-shaped knobs usable to lift the lid and formed on opposite side walls of the lid. Therefore, when the lid is to be opened from the container body, if a user holds a container body with one hand and lifts up a knob formed one side of the lid with the other hand, the container body may be shaken by an opening force due to a tight locked state, and thus food and broth may spill out from the container body.

Particularly, the larger the size of a conventional airtight container is, the more frequently the contents contained in the container body may escape due to shaking due to an opening force of the lid. This is because a large airtight container inevitably requires a large lid, and the large size of the lid inevitably results in a large rotating knob having a latching groove for maintaining the lid in a locked state with the container body or a large latching protrusion inserted into the latching groove, thereby increasing the latching load for maintaining the tight locked state. Therefore, a predetermined force is required to open the lid, and thus housewives and children who relatively frequently use an airtight container cannot easily open the lid without shaking of the container body.

Meanwhile, in the conventional airtight container, when the container body and the lid are not maintained in a locked state, the rotating knob formed on opposite side walls of one selected from the container body and the lid is maintained in a state where the knob elastically protrudes in a horizontal direction from the opposite side walls of the container body. For example, in a case where a plurality of airtight containers each including a lid and a container body separated from each other are stacked and packed, when only a plurality of container bodies are stacked and then a plurality of stacked lids are stacked on the stacked container bodies, rotating knobs formed on opposite side walls of the container bodies are maintained in a state where the knobs protrude toward one side without being folded by themselves due to an elastic force.

When the rotating knob is maintained in the state where the knob protrudes toward one side as described above, a packaging case for packing the airtight containers is required to have a relatively large size and thus have an unnecessarily increased capacity. Moreover, it is difficult to maintain an alignment state of stacked units in the package or a shape of the package.

In brief, the rotating knob having a latching groove and installed on either of the container body and the lid configuring the conventional airtight container as described above just maintains or releases a locked state of the container body and the lid, but does not have a configuration which enables the rotating knob to directly push the lid up from the container body to open the lid.

Prior Art document 1: Korean Patent Publication (Application No. 10-2003-0074940; published on Apr. 29, 2005), Prior Art document 2: Korean Utility Model Registration Publication (Application No. 20-2003-0008580; published on Jun. 18, 2003), Prior Art document 3: Korean Utility Model Registration Publication (Application No. 20-2003-0039462; published on Mar. 24, 2004), and Prior Art document 4: Korean Utility Model Registration Publication (Application No. 20-2004-0015848; published on Sep. 1, 2004).

Meanwhile, FIG. 5 is a partial cross-sectional view showing an airtight structure between a container body and a lid, which configure a conventional A-type airtight container and include a locking member.

As noted from the drawing, a conventional airtight container includes a container body 100 and a lid 101 for opening or closing an opening of the container body. The lid 101 has a groove 104 formed inside a peripheral edge portion 103 thereof, and a packing 105 for maintaining airtightness of the container body is disposed in the groove and comes into contact with a bump 106 formed in a circumferential direction of the container body 100 to maintain the airtightness. Further, the lid 101 has a latching piece 108 disposed thereon, which protrudes from an inner wall of a locking member 107. The latching piece 108 can be tightly engaged with or released from a latching bump 109 protruding from the outer wall of the container body 100 to maintain or release the air-tight coupling between the container body 100 and the lid 101.

However, in the conventional airtight container as described above, when the lid is locked in a part of four sides of the airtight container by the locking member, a portion of the lid of the remaining portion except for a corresponding portion of the lid that maintains a locked state is lifted upwards. Therefore, air frequently flows into and out of the container body, and the fluid of food contained in the container body spills out to the outside. In addition, with respect to the lid, since the packing is forcedly inserted into the lid, mold is generated in the packing when used for a long period of time, and the packing is decayed or deformed so that a spaced gap is generated in the long run. As a result, air frequently flows into and out of the container body and the fluid of food contained in the container body spills out to the outside.

Meanwhile, FIG. 6 is a partial cross-sectional view showing an airtight structure between a container body and a lid, which configure a conventional B-type airtight container and include a locking member.

As noted from the drawing, a conventional airtight container includes a container body 200 and a lid 201 for opening or closing an opening of the container body 200. The lid 201 has a groove 203 formed inside a peripheral edge portion 202 thereof, and a ∩-shaped packing 208 for maintaining airtightness of the container body 200 is disposed in the groove and comes into contact with a bump 204 formed in a circumferential direction of the container body 200 to maintain the airtightness. Further, a protrusion 207 protruding from the outer wall of the container body 200 is inserted into and tightly engaged with or released from a hole 206 formed in a locking member 205 disposed on the lid 201 to maintain the coupling between the container body 200 and the lid 201.

However, with respect to the lid, since the ∩-shaped packing is forcedly inserted into the lid or installed in a double injection manner (insert injection) and a gap of the packing is very narrow such that the bump of the container body can be airtightly received, the lid is not easily opened because the bump of the container body is held by a strong elastic force of the packing in a state in which the bump of the container body is airtightly inserted into the packing while the lid is opened. In addition, even when the lid is opened, the container body is shaken by an opening force applied to the lid, and thus the fluid of food contained in the container body spills out to the outside.

Meanwhile, FIG. 7 is a partial cross-sectional view showing an airtight structure between a container body and a lid, which configure a conventional C-type airtight container and include no locking member.

As noted from the drawing, a conventional airtight container includes a container body 300 and a lid 301 for opening or closing an opening of the container body 300. The lid 301 has an inner wall 303 having a predetermined height and formed inside a peripheral edge portion 302 thereof, and a holding wall 305 having transverse elasticity is disposed on one side with a spaced gap 304 between the inner wall 303 the one side so that a bump 306 portion formed in a circumferential direction of the container body 300 is inserted into the spaced gap 304 and supported by the holding wall 305. Thus, the holding wall maintains a fixed state between the container body 300 and the lid 301.

However, in the airtight container as described above, the bump 306 of the container body is inserted into the spaced gap between the inner wall and the holding wall of the lid without a locking member so that the container body and the lid are just maintained in a fixed state. Therefore, air frequently flows into and out of the container body, and the fluid contained in the container body spills out to the outside.

Further, FIG. 8 is a partial cross-sectional view showing an airtight structure between a container body and a lid, which configure a conventional D-type airtight container and include no locking member.

As noted from the drawing, in a conventional airtight container, a latching bump 403 facing one side is formed on an inner wall 402 of an edge portion 405 formed along a circumferential direction of an upper side of a container body 400, and an insertion groove 406 into which the edge portion 405 of the container body 400 is to be inserted is formed inside a peripheral edge portion 410 of the lid 401. Further, a protrusion 408 facing the latching bump 403 is formed on an inner wall 407 of the lid 401 configuring the insertion groove 406. When the lid 401 is closed, the protrusion 408 comes in contact with a portion just below the latching bump 403, so as to prevent the lid 401 from being easily separated from the container body 400.

However, the latching bump and the protrusion prevents the lid from being easily separated from the container body but cannot maintain the airtight state through contact between the latching bump and the inner wall of the protrusion. The main reason why the airtight state cannot be maintained is that, since the container body is made of polypropylene (PP), and the lid and the protrusion formed on the inner wall of the lid are made of polypropylene (PP), the latching bump and the protrusion are worn down when the lid opens or closes the container body repeatedly for a long period of time, so that the airtight state cannot be maintained. Further, since the lid and the latching bump are made of thin polypropylene (PP), the lid and the latching bump act sensitively to a change in temperature and thus have deformed shapes, so that it is difficult to maintain the airtight state. Therefore, air frequently flows into and out of the container body of the airtight container, and the fluid of food contained in the container body spills out to the outside.

In addition, FIG. 9 is a partial cross-sectional view showing an airtight structure between a container body and a lid, which configure a conventional E-type airtight container and include no locking member.

As noted from the drawing, a conventional airtight container includes a container body 500 and a lid 510 for opening or closing an opening of the container body. The drawing illustrates an airtight container having no locking member installed on one of the container body 500 and the lid 510 to fix the lid 510 to the container body 500.

In a conventional airtight container shown in the drawing, a packing member 511 made of soft resin or silicon is formed on an inner wall 512 of the lid 510 for opening or closing the opening of the container body 500 by double injection (insert injection) of the packing member together with the lid made of polypropylene (PP). The packing member 511 horizontally and lengthily protrudes toward one side before the opening of the container body 500 is closed by the lid 510. When the lid 510 is closed, the packing member 511 comes into contact with a wall 513 configuring the container body 500 and is bent inward and folded. Therefore, the packing member 511 comes into contact with the wall 513 of the container body so that airtightness is maintained.

However, since the packing member installed on the lid has a large working space for being in contact with the wall of the container body, the capacity of the container is reduced. In addition, when the lid is closed, the air inside the container body flows out as much as the lid is lowered to the inside of the container body, so that the inside of the container body is in a weak vacuum state. Thus, when the lid is opened again, the lid is not opened easily and the container body is greatly shaken by an opening force applied to the lid, so that food contained in the container body is spilled. Therefore, it is troublesome to install a valve for air inlet and outlet in the lid to prevent the problem described above.

Particularly, in the conventional airtight container as described above, the packing member disposed in a circumferential direction of the lid protrudes longer than necessary. Therefore, when the fluid in the container body is shaken, the contact portion between an end surface of the packing member and the wall is lifted by pressure of a fluid in the container body, and thus a gap is generated. As a result, the fluid spills out through the gap and thus airtightness cannot be maintained.

There are also various types of conventional airtight containers having a packing. However, irrespective of the presence of a locking member for binding a container body and a lid, structural defects of packings installed in all of the containers and the deformation due to the defects frequently cause air to flow into or out of the container body and causes the fluid of food contained in the container body to spill out to the outside.

Prior Art document 5: Korean Utility Model Registration publication No. 0248959 (published on Oct. 19, 2001), Prior Art document 6: Korean Patent Registered Utility Model Registration publication No. 0301897 (published on Jan. 29, 2003).

DETAILED DESCRIPTION OF THE INVENTION

Technical Problem

The present invention has been made in order to solve the conventional problems described above. An object of the present invention is to provide an airtight container, wherein a user can easily and simply open a lid from a container body without difficulty nor shaking of the container body, by only "the principle of the lever", which allows the user to easily lift and rotate rotating knobs installed on opposite side walls of the container body upwardly, so that even housewives and children can easily open the lid.

Another object of the present invention is to provide an airtight container, wherein, when container bodies and lids are stacked and packed in a predetermined unit, respectively, lid extension portions of a plurality of stacked lids positioned on the upper side of a plurality of stacked container bodies press all of rotating knobs connected to opposite side walls of the container bodies to be folded to face the opposite side walls of the container bodies so as to maintain the rotating knobs in a vertical state. Therefore, the container bodies and the lids can be easily stacked and packed, a packing case can be prevented from having an unnecessarily increased capacity, and an alignment state of the shape of stacked units in the package can be easily maintained.

Another object of the present invention is to provide an airtight container, wherein, regardless of whether a locking member is installed on one selected from a container body and a lid configuring the airtight container, an inner wall of the lid has a closed loop-shaped packing member formed of a soft resin (silicone) and including a protrusion having an end facing a latching bump and having one shape selected from a curved protrusion shape and a curved wedge shape in a predetermined height, and the packing member is double injected (insert injection) into the inner wall of the lid formed of polypropylene (PP), such that the packing member can airtightly come into contact with an inner wall of the container body, thereby effectively preventing air from flowing into and out of the airtight container and reducing the airtight contact surface between an end of the packing member and the inner wall of the container body. Therefore, the lid can be easily opened without shaking of the container body even with a small force so that the fluid of food contained in the container body can be prevented from spilling out to the outside.

Technical Solution

The present invention relates to an airtight container including a container body having an opening formed on an upper portion thereof, a lid for opening or closing the opening of the container body, and a rotating knob hingedly-connected to one of the container body and the lid, the airtight container comprising: the container body including a latching bump formed along an upper inner surface of an inner wall of the container body and a flange extending outwardly from an upper portion of the inner wall and then bent downward thereby forming a groove therein; the rotating knob connected to the flange and having an opening-closing plate and a step portion, and being vertically rotatable; and the lid including a latching protrusion formed along on an inner wall surface of an inner wall, a downwardly bent flange extending outwardly from a circumference of the inner wall and capable of being coupled downwardly to the flange, and a lid extension portion formed at the flange, wherein the lid extension portion 33 is in contact with the opening-closing plate 27 and the step portion 28 in a state where the lid 30 is coupled to the container body 20, or when the rotating knob 29 is rotated upward in the state where the lid 30 is coupled to the container body 20, and wherein, when the rotating knob 29 is just rotated upward in the state where the lid 30 is coupled to the container body 20, the opening-closing plate 27 lifts the lid extension portion 33 by "the principle of the lever" and the step portion 28 prevents the lid extension portion 33 contacted with the step portion 28 from spreading outwards, thereby allowing the latching protrusion 32 to be released from the latching bump 24 and the lid 30 to be opened from the container body 20.

Preferably, the step portion is formed so as to extend outwards from a lower portion of an upper end of the opening-closing plate.

More preferably, the latching bump and the latching protrusion are formed in a closed-loop-shape.

Preferably, the rotating knob is rotatably connected to the flange through a film hinge and an extension bump is formed between the flange and the rotating knob so as to extend outwards from the flange.

Also preferably, the rotating knob is rotatably connected to the flange through an film hinge connected to the extension bump.

Preferably, the latching protrusion is formed by a closed loop-shaped packing member made of a soft resin and including a protrusion portion protruding from the inner wall surface of the lid towards the latching bump, and the packing member is fixed to the inner wall surface of the lid made of a material different from the packing member by a double injection (insert injection), so that the protrusion portion can be latched directly below the latching bump.

Preferably, the protrusion portion is formed in a curved protrusion shape or a curved protruded wedge shape.

More preferably, the soft resin is silicon.

Advantageous Effects

According to the present invention as described above, since rotating knobs installed on opposite side walls of a container body are lifted up and rotated by just "the principle of the lever" so that a lid can be easily and simply opened from the container body without difficulty, a weak opening force for opening the lid is applied and thus the container body is not shaken. Therefore, the present invention can prevent food or broth from spilling from the container body in advance, and even the elderly and children can easily and simply open the lid without difficulty nor shaking irrespective of the size of an airtight container to which the present invention is applied.

Further, when container bodies and lids are stacked and packed in a predetermined unit, respectively, lid extension portions of a plurality of stacked lids positioned on the upper side of a plurality of stacked container bodies allow all of rotating knobs installed on opposite side walls of the container bodies to be folded to face the opposite side walls of the container bodies so as to maintain the rotating knobs in a vertical state, thereby easily stacking and packing the container bodies and the lids. Therefore, the present invention can prevent a packing case from having an unnecessarily increased capacity, and easily maintain an alignment state of stacked units in the package or a shape of the package so that the reliability of a product can be enhanced.

In addition, regardless of whether a locking member is installed on one selected from the container body and the lid configuring the airtight container, an inner wall of the lid has a closed loop-shaped packing member formed of a soft resin and including a protrusion having an end facing a latching bump and having one shape selected from a curved protrusion shape and a curved wedge shape in a predetermined height, and the packing member is double injected (insert injection) into the inner wall of the lid formed of polypropylene (PP), so that the packing member can come into contact with an inner wall of the container body. Therefore, the present invention can effectively prevent air from flowing into and out of the airtight container. Further, the airtight contact surface between an end of the packing member and the inner wall of the container body is reduced, so that the lid can be easily opened without shaking of the container body even with a small force. Accordingly, the present invention can prevent the fluid of food contained in the container body from spilling out to the outside.

MODE FOR CARRYING OUT THE INVENTION

Hereinafter, the present invention will be described in detail with reference to the accompanying drawings.

Figure 1:
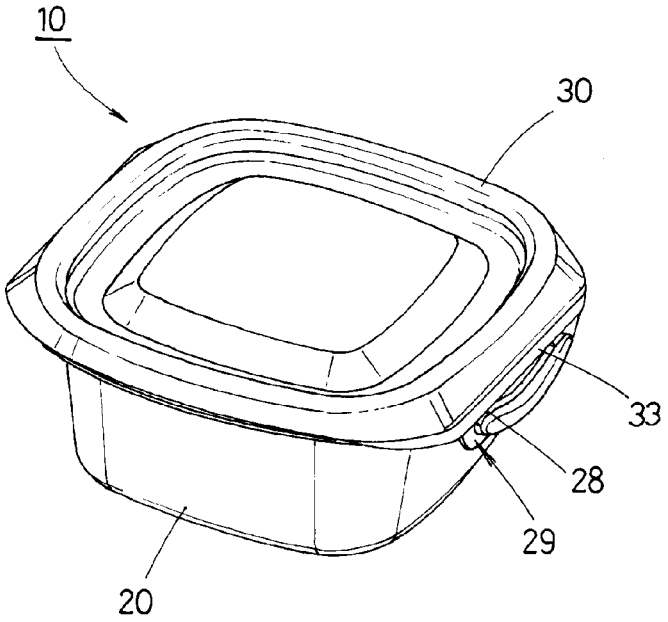
FIG. 1 is a perspective view showing an appearance of an airtight container according to the present invention.
Figure 2:
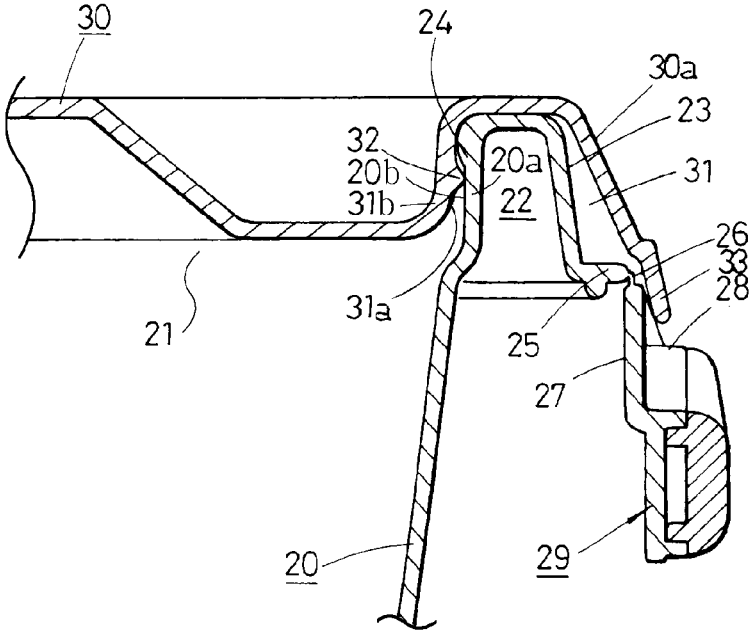
FIG. 2 is an enlarged partial cross-sectional view of a main portion in a state where a container body and a lid are coupled to each other according to the present invention.
Figure 3:
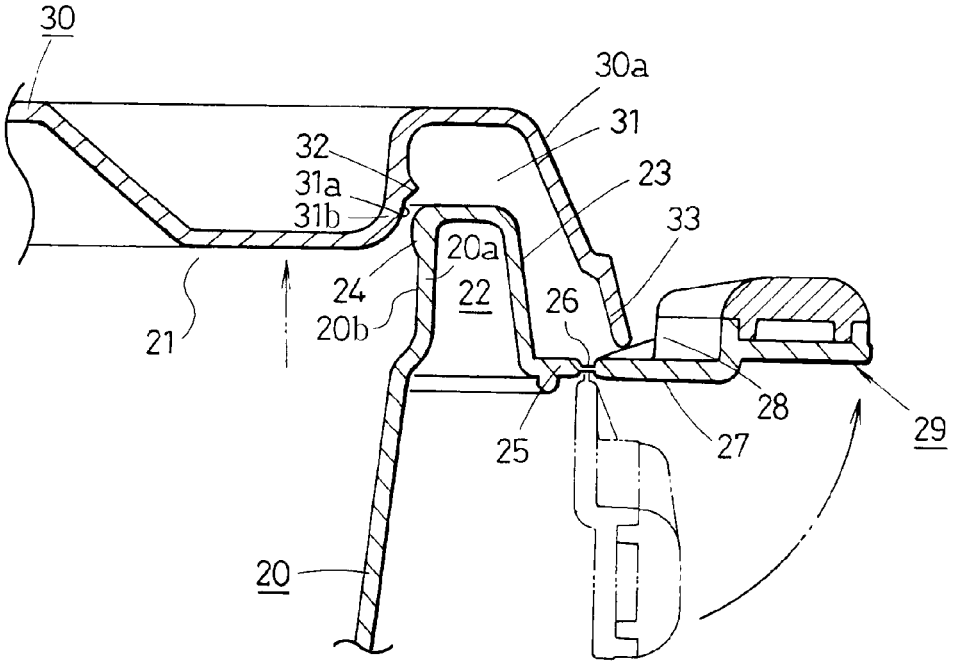
FIG. 3 is a sectional view showing a state where a lid is opened from a container body by lifting a rotating knob according to FIG. 2.

FIG. 1 is a perspective view showing an appearance of an airtight container according to the present invention, FIG. 2 is an enlarged partial cross-sectional view of a main portion in a state where a container body and a lid are coupled to each other according to the present invention, and FIG. 3 is a sectional view showing a state where a lid is opened from a container body by lifting a rotating knob according to FIG. 2.

As noted from the drawings, the airtight container 10 according to the present invention includes a container body 20 and a lid 30 for opening or closing an opening 21 of the container body 20. The container body 20 and the lid 30 are made of a synthetic resin (polypropylene (PP)) having elasticity, and the shape thereof may be variously formed in a circular shape, or a polygonal shape including a quadrangle.

A flange 23 having a groove 22 formed inside thereof is formed on the outer wall along a circumferential direction of the container body 20 according to the present invention, and a latching bump 24 is formed on an inner wall surface 20*b* of an inner wall 20*a* at the opening 21. A groove 31 is formed in a downwardly bent flange 30*a* along the circumferential direction of the lid 30, and a latching protrusion 32 to be latched by the latching bump 24 is formed on an inner wall surface 31*a* of an inner wall 31*b* which forms the groove 31. The lid 30 and the container body 20 are maintained in a locked state while being coupled to each other.

In a lower end of each side of the flange 23 of the container body 20 according to the present invention, an extension bump 25 is formed to extend in a predetermined length from the lower end toward the outer horizontal direction. A thin film hinge 26 is connected to the extension bump 25, an opening-closing plate 27 having a predetermined length is connected to the film hinge 26, and a step portion 28 having a predetermined length is formed outwardly from a lower end of the opening-closing plate 27, so that a rotating knob 29 vertically rotated by a user is formed.

A lid extension portion 33 extending downward from the outer peripheral wall of the lid 30 is formed in a circumferential direction of the outer peripheral wall of the lid 30 according to the present invention. Therefore, preferably, the inner wall of the lid extension portion 33 is in contact with the outer wall of the opening-closing plate 27, and a lower end of the lid extension portion 33 is positioned close to (referring to FIG. 4(*a*)) or contact with (referring to FIG. 4(*b*)) the step portion 28 in a state where the container body 20 and the lid 30 are coupled to each other to maintain a locked state. That is, the lid extension portion 33 is in contact with the opening-closing plate 27 and the step portion 28 in a state where the lid 30 is coupled to the container body 20, or when the rotating knob 29 is rotated upward in the state where the lid 30 is coupled to the container body 20. The step portion 28 serves to prevent the lid extension portion 33 from spreading outward when the rotating knob 29 is rotated. Therefore, the step portion 28 may have a shape as shown in the present invention, but may be replaced with a small protrusion or the like as long as it can perform the role of the step portion 28 according to the present invention.

The airtight container 10 according to the present invention is configured such that, as shown in FIG. 2, the lid 30 and the container body 20 are maintained in a locked state by the latching bump 24 and the latching protrusion 32 in a state where the container body 20 and the lid 30 are coupled to each other.

When a user opens the lid 30 from the container body 20 in a state where the container body 20 and the lid 30 are coupled to each other, the user brings the thumb of both hands into contact with each other while facing each other on the surface of the lid 30 and slightly lifts and rotates the rotating knob 29 by using the remaining fingers, so that, the opening-closing plate 27 configuring the rotating knob 29 lifts a lower end of the lid extension portion 33, by only "the principle of the lever" and, as shown in FIG. 3, lid 30 is easily opened from the container body 20 while the container body 20 and the lid 30 are released from the locked state.

In this case, the step portion 28 formed on the rotating knob 29 prevents the lid extension portion 33 contacted with the step portion 28 from spreading outward when the opening-closing plate 27 lifts the lid extension portion 33, thereby guiding upward movement of the lid extension portion 33 lifted by the opening-closing plate 27 to enable the lid 30 to be opened quickly and easily. Accordingly, the lid 30 can be easily opened by the above operation, so that the container body 20 is not shaken, so that the food or food broth contained in the container body 20 does not spill out.

Figure 4A:
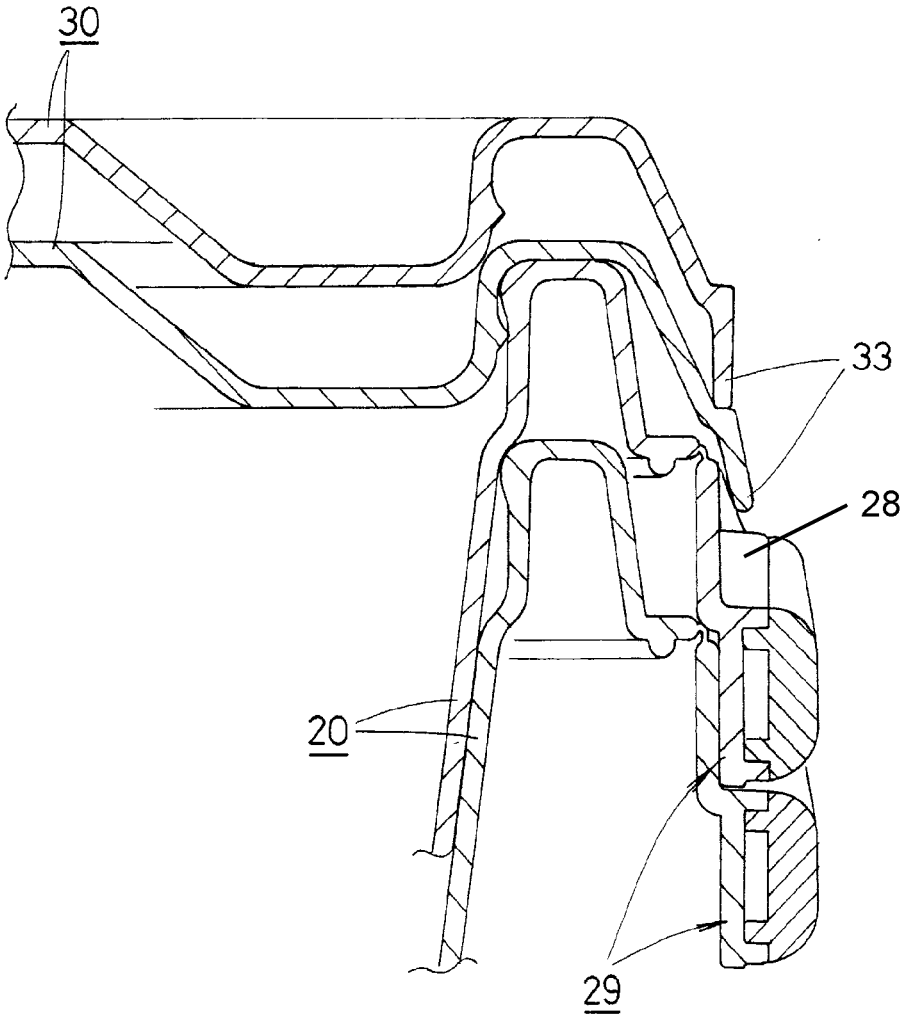
FIGS. 4(*a*) and 4(*b*) are partial cross-sectional side views showing a unit packaging state in which a plurality of container bodies and lids are stacked less close together and more close together, respectively, according to the present invention.
Figure 4B:
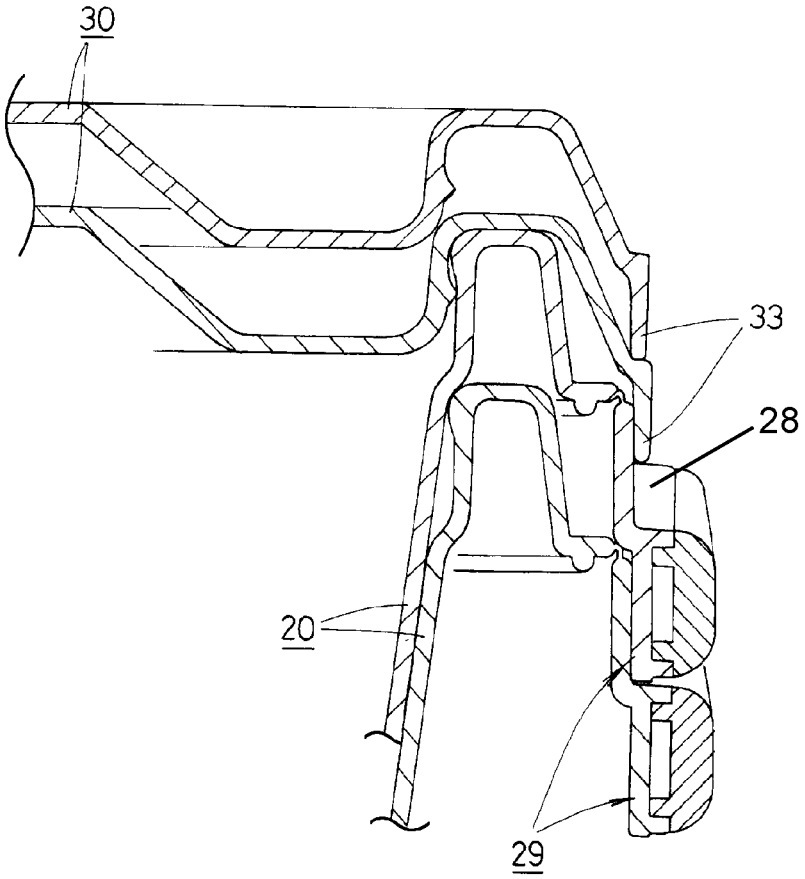
Figure 5:
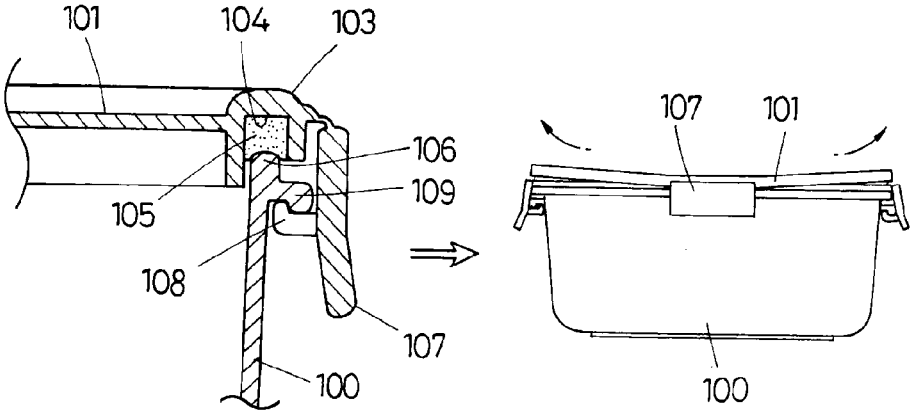
FIG. 5 (PRIOR ART)
FIG. 5 is a partial cross-sectional view showing an airtight structure between a container body and a lid, which configure a conventional A-type airtight container and include a locking member.
Figure 6:
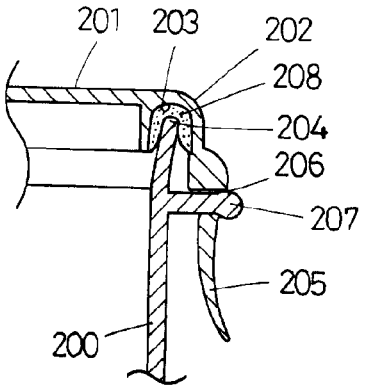
FIG. 6 (PRIOR ART)
FIG. 6 is a partial cross-sectional view showing an airtight structure between a container body and a lid, which configure a conventional B-type airtight container and include a locking member.
Figure 7:
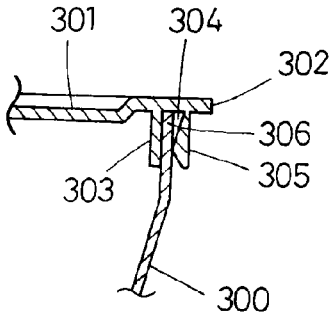
FIG. 7 (PRIOR ART)
FIG. 7 is a partial cross-sectional view showing an airtight structure between a container body and a lid, which configure a conventional C-type airtight container and include no locking member.
Figure 8:
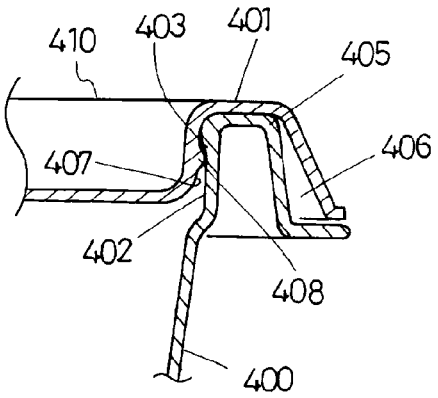
FIG. 8 (PRIOR ART)
FIG. 8 is a partial cross-sectional view showing an airtight structure between a container body and a lid, which configure a conventional D-type airtight container and include no locking member.
Figure 9:
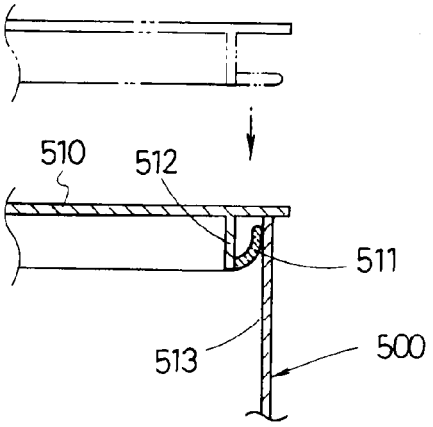
FIG. 9 (PRIOR ART)
FIG. 9 is a partial cross-sectional view showing an airtight structure between a container body and a lid, which configure a conventional E-type airtight container and include no locking member.

Meanwhile, FIGS. 4(*a*) and 4(*b*) are reference views showing a unit packaging state in which a plurality of container bodies and lids are stacked according to the present invention. According to the airtight container 10 of the present invention, container bodies 20 and lids 30 may be stacked and packed in a predetermined unit, respectively. The lid extension portion 33 may be configured to be or not to be in contact with the step portion 28 of the rotating knob 29 in an initial state where the lid 30 is coupled to the container body 20 (referring to FIGS. 4 (*a*) and (*b*)).

The lid extension portion 33 of the lid 30 located at the lower portion of a plurality of lids 30 located on the upper side of a plurality of stacked container bodies 20 is in contact with the outer wall of an opening-closing plate 27 of a container body located on the upper side of the plurality of stacked container bodies 20, so that the rotating knob 29 is oriented downward to maintain a downward state, preferably a vertical state. Accordingly the rotating knobs 29 formed on all of the container bodies 20 stacked under the container body having the rotating knob oriented downward are oriented downward toward opposite wall sides of the container bodies 20 and are folded to maintain a downware state, preferably a vertical state as described above, so that a stacked packaging is easy. Therefore, it is possible to prevent a package case from having an unnecessarily increased capacity, and it is also easy to maintain an alignment state of the shape of stacked units in the package.

According to the airtight container of the present invention, even the elderly and children can easily and simply open the lid without difficulty nor shaking of the container body, by only "the principle of the lever", which allows a user to easily lift and rotate only rotating knobs installed on opposite side walls of the container body upwardly. Therefore, it is possible to prevent food or food broth from spilling from the container body in advance, to easily pack stacked container bodies and stacked lids when the container bodies and the lids are stacked and packed in a predetermined unit, respectively, to prevent a packaging case from having an unnecessarily increased capacity, and to easily maintain an alignment state of the shape of stacked units in the package.

Figure 10A:
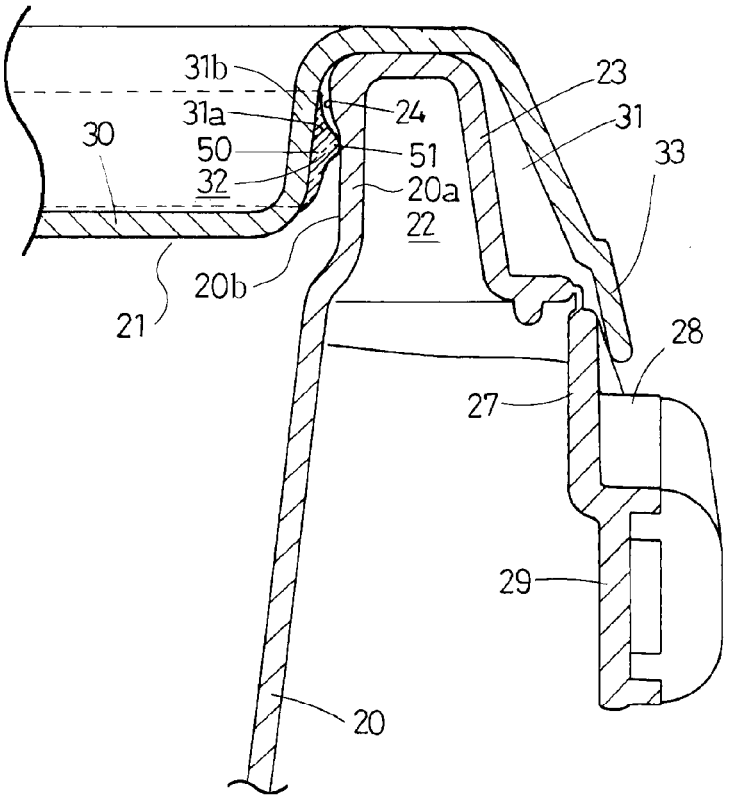
FIG. 10(*a*) is a partial cross-sectional view showing a state in which a packing member is double injected (insert injection) into a lid according to the present invention, and FIG. 10(*b*) is a partial cross-sectional view showing a state in which the rotating knob is rotated upward by alternated long and short dash line.
Figure 10B:
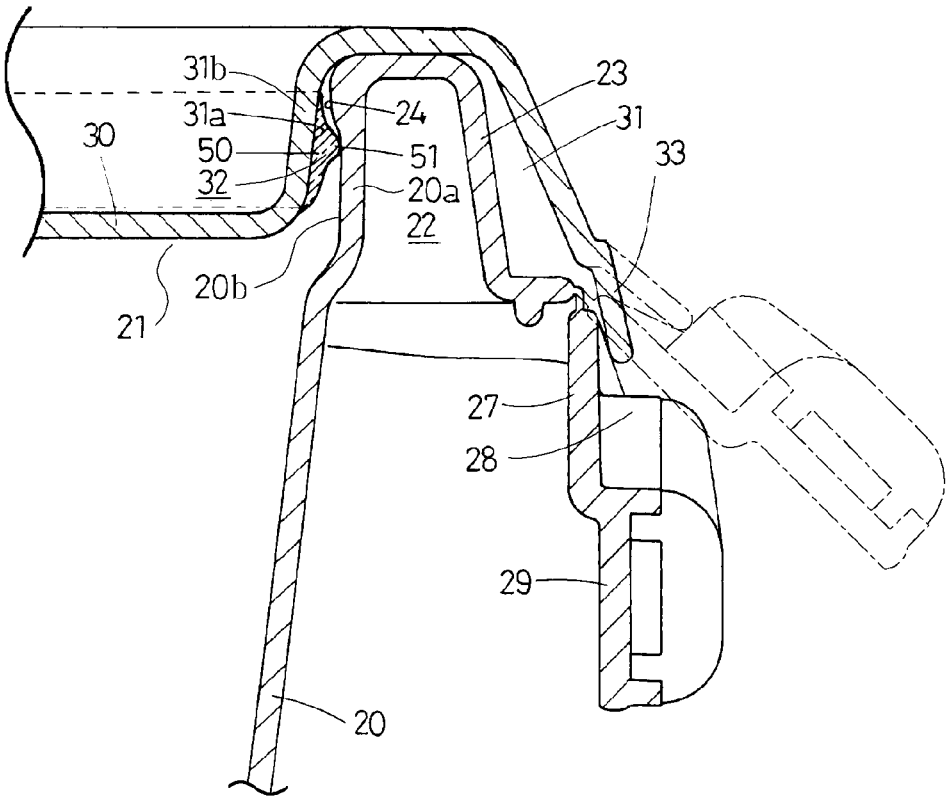

FIG. 10(*a*) is a partial cross-sectional view showing a state in which a packing member is double injected (insert injection) into a lid according to the present invention, and FIG. 10(*b*) is a partial cross-sectional view showing a state in which the rotating knob is rotated upward by alternated long and short dash line.

As noted from the drawing, the airtight container according to the present invention includes a container body 20 and a lid 30 for opening or closing an opening of the container body. The container body 20 and the lid 30 are formed of polypropylene (PP), and the shape of the airtight container may be formed into various shapes including a circular shape, a square shape, or a rectangle shape. Particularly, the characteristic elements of the present invention may be applied to the lid 30 regardless of the presence or absence of a locking member for binding the container body 20 and the lid 30.

An inner wall surface of the lid 30 formed of a polypropylene (PP) material has a packing member 50 formed of a soft resin (silicon) and formed by double injection (insert injection) with the lid 30 toward a closed loop-shaped latching bump 24 formed on an inner wall surface of the container body 20. A protrusion portion 51 having a predetermined height is formed in an end of the packing member 50, and the protrusion portion 51 may have a curved protrusion shape facing one side or a curved wedge shape. Therefore, in the present invention, the protrusion portion may have one selected from the curved protrusion shape and the curved wedge shape.

The packing member 50 according to the present invention is fixed to the inner wall surface 31*a* of the lid 30 through a double injection (insert injection), such that the protrusion portion 51 may be engaged with or released from a portion just below the latching bump 24 formed on the inner wall surface 20*b* of the container body. A connection portion of the flange 23 forming the side wall of the lid 30 may be or may not be applicable to the present invention.

According to the present invention, when the opening of the container body 20 is closed by the lid 30, the protrusion portion 51 configuring the packing member 50 is engaged with or released from a portion just below the latching bump 24 formed on the inner wall 20*a* of the container body 20, and thus the lid 30 is kept closed in the container body 20. When a user opens the lid 30, the contact area with the inner wall surface of the container body 20 is small since the protrusion portion 51 has a curved protrusion shape or a curved protruded wedge shape with a predetermined height, so that the container can be easily opened even with a small force.

According to the present invention, regardless of whether a locking member is installed on one selected from a container body and a lid configuring the airtight container, an inner wall of the lid has a packing member formed of a soft resin which is a material different from the lid and including a protrusion portion having a curved wedge shape, and the packing member is double injected (insert injection) into the inner wall of the lid. Therefore, the protrusion portion minimizes the contact area with the container body so that the lid can be easily opened even with a small force, and the packing member effectively prevents air from flowing into and out of the airtight container and prevents the fluid of food contained in the container body from spilling out to the outside.

The terms and words used in the present specification and claims should not be construed in conventional and dictionary definition, and the inventor can properly define the concept of the term to describe his/her invention in the best way possible. The present invention should be construed in accordance with the meaning and concept consistent with the technical idea of the present invention.

Therefore, embodiments described in the present specification and configurations shown in the drawings are only for the preferred embodiments of the present invention, and not all of the technical ideas of the present invention are described. Therefore, it should be understood that various equivalents and variations examples that can be substituted at the time of the present application may be present.

The invention claimed is:

1. An airtight container (10) including a container body (20) having an opening formed on an upper portion thereof, a lid (30) for opening or closing the opening of the container body (20), and a rotating knob (29) hingedly-connected to the container body (20), the airtight container comprising:

the container body (20) including a latching bump (24) formed along an upper inner wall surface (20*b*) of an inner wall (20*a*) of the container body and a flange (23) extending outwardly from an upper portion of the inner wall (20*a*) and then bent downward thereby forming a groove (22) therein;

the rotating knob (29) connected to the flange (23) and having an opening-closing plate (27) and a step portion (28), and being vertically rotatable; and the lid (30) including a latching protrusion (32) formed along on an inner wall surface (31*a*) of an inner wall (31*b*), a downwardly bent flange (30*a*) extending outwardly from a circumference of the inner wall (31*b*) and capable of being coupled downwardly to the flange (23), and a lid extension portion (33) formed at the flange (30*a*), wherein the lid extension portion (33) is in contact with the opening-closing plate (27) and the step portion (28) in a state where the lid (30) is coupled to the container body (20), or when the rotating knob (29) is rotated upward in the state where the lid (30) is coupled to the container body (20), and wherein, when the rotating knob (29) is just rotated upward in the state where the lid (30) is coupled to the container body (20), the opening-closing plate (27) lifts the lid extension portion (33) and the step portion (28) prevents the lid extension portion (33) contacted with the step portion (28) from spreading outwards, thereby allowing the latching protrusion (32) to be released from the latching bump (24) and the lid (30) to be opened from the container body (20).

2. The container of claim 1, wherein the step portion (28) is formed so as to extend outwards from a lower portion of an upper end of the opening-closing plate (27).

3. The container of claim 1, wherein the latching bump (24) and the latching protrusion (32) are formed in a closed-loop-shape.

4. The container of claim 1, wherein the rotating knob (29) is rotatably connected to the flange (23) through a film hinge (26).

5. The container of claim 1, wherein an extension bump (25) is formed between the flange (23) and the rotating knob (29) so as to extend outwards from the flange (23).

6. The container of claim 5, wherein the rotating knob (29) is rotatably connected to the flange (23) through a film hinge (26) connected to the extension bump (25).

7. The container of claim 1, wherein the latching protrusion (32) is formed by a closed loop-shaped packing member (50) made of a soft resin and including a protrusion portion (51) protruding from the inner wall surface (31*a*) of the lid (30) towards the latching bump (24), and the packing member (50) is fixed to the inner wall surface (31*a*) of the lid (30) made of a material different from the packing member (50) by a double injection (insert injection), so that the protrusion portion (51) can be latched directly below the latching bump (24).

8. The container of claim 7, wherein the protrusion portion (51) is formed in a curved protrusion shape or a curved protruded wedge shape.

9. The container of claim 7, wherein the soft resin is silicone.

* * * * *